United States Patent [19]

Chabrerie et al.

[11] Patent Number: 4,483,574

[45] Date of Patent: Nov. 20, 1984

[54] SLIDING ELECTRICAL CONTACTS FOR ELECTRIC MACHINERY

[75] Inventors: Jean P. Chabrerie, Gif-sur Yvette; Jacques C. Barthélemy, Cachan; Michel L. Amiet, Paris, all of France

[73] Assignee: Etat Francais, France

[21] Appl. No.: 202,874

[22] Filed: Oct. 31, 1980

[30] Foreign Application Priority Data

Nov. 8, 1979 [FR] France ..... 79 27526

[51] Int. Cl.[3] ..... H01R 39/00

[52] U.S. Cl. ..... 339/5 L; 310/219

[58] Field of Search ..... 310/232, 219, 248–251, 310/233, 236, 178, 237; 200/164 R, 182, 230; 339/5 L, 8 L

[56] References Cited

U.S. PATENT DOCUMENTS

| | | | |
|---|---|---|---|
| 3,052,764 | 9/1962 | De Rugeris | 310/248 |
| 3,886,386 | 5/1975 | Hillig | 310/251 |
| 4,019,076 | 4/1977 | Bates | 310/232 |
| 4,168,446 | 9/1979 | Hatch | 310/219 |
| 4,337,407 | 6/1982 | Hummert | 310/251 |
| 4,347,456 | 8/1982 | Chabrerie | 310/239 |
| 4,358,699 | 11/1982 | Wilsdorf | 310/251 |

FOREIGN PATENT DOCUMENTS

| | | | |
|---|---|---|---|
| 620087 | 5/1933 | Fed. Rep. of Germany | 310/248 |
| 894277 | 10/1953 | Fed. Rep. of Germany | 310/248 |
| 1332786 | 8/1973 | United Kingdom | 310/178 |

*Primary Examiner*—R. Skudy

*Attorney, Agent, or Firm*—Parkhurst & Oliff

[57] ABSTRACT

Sliding electric contacts are disclosed which may be used, for example, to maintain electrical contact between two moving parts in a rotating machine. Electrical contact between two such parts separated by a constant average distance is maintained during movement of the parts by use of at least one multifilament brush formed as a bundle of thin wires having a fixed end and a free end wherein the free end has a length which is at least 10 percent greater than the constant average distance between the moving parts. The moving parts may be in the form of various configurations of commutators and the electric contacts may be used to maintain electrical contact between the parts within a fluid medium.

5 Claims, 7 Drawing Figures

SLIDING ELECTRICAL CONTACTS FOR ELECTRIC MACHINERY

BACKGROUND OF THE INVENTION

The present invention relates to electric contact devices which slide between two parts which move relative with to each other, a first one of said parts bearing at least one multifilament brush formed of a bundle of endless wires held at one of its ends in the first part and at its other end bearing against at least one contact zone arranged on the second part.

Sliding electric contacts are found in most electrical engineering installations both in the form of wiper shoes and in combination with collector rings or collectors of rotating machines. In the early rotating machines, the wire contactors now call brushes, have been replaced everywhere by metalgraphite or electrographite brush systems. These latter devices have their well-known limitations with respect to the current density which they can transmit, with respect to the amount of contact potential difference and the problems related to friction and wear, particularly when the speed of travel is high.

The contact pressure necessary for metallographitic brushes and the phenomena appearing at the interface between them and the contact zone of the associated rotating part have up to now limited their use to a normal or preferably inert atmosphere, preventing their use in more hostile gaseous environments and particularly in liquids.

Now the solution of this problem of immersion would satisfy very many demands. Thus, with respect to hostile gaseous conditions, the contact shoes of railway motor cars very frequently become unusable as a result of constant precipitation or due to the persistence of thick saline fogs. As for electric motors and more particularly dc motors, they rapidly prove very limited, particularly because of problems associated with brush pressure, both in aeronautics when a certain ceiling must be exceeded, and when submerged where, almost exclusively for the brush-collector subassemblies, thick-hull structures resistant to pressure must be provided, and the problems in tightness resulting therefrom must be resolved.

With a motor which is capable of operating while immersed, a thin hull enclosure, placed under equipressure, would make it possible to solve most of the structural problems and those inherent with tightness, thus permitting important developments for small auxiliary motors for equipment of submarine vehicles or underwater drilling installations. Finally, for simple matters of optimal location and utilization of available space it will be understood that the possibility of immersion, for instance of a fuel pump in an airplane wing tank, as well as in a car fuel tank, would afford very great advantages.

The conventional metallographitic or electrographitic brushes as stated above must be used in relatively controlled atmospheres and, differing from other turning parts of electrical machines encounter, when immersed in a liquid medium, almost insurmountable difficulties related to the pressure to be applied to the brushes in order to counteract the lifting force created by the "oil wedge" below the brushes and the related phenomena of electro-erosion which very rapidly make these conventional brushes ineffective.

SUMMARY OF THE INVENTION

The object of the present invention is to provide a sliding electric contact device with a multifilament brush which permits undifferentiated use, under normal conditions or when immersed in a non-oxidizing fluid of low viscosity, whether gaseous or liquid, whatever the pressure of such gas or liquid.

Another object of the present invention is to provide a sliding electric contact device of this type which, upon operation in a gas or liquid, permits substantial current densities without a high contact potential difference at to high linear speeds.

In order to achieve this, in accordance with one feature of the present invention, the multifilament brush formed of a fixed bundle of endless wires has an overhang length which advantageously exceeds by at least 10% the normal average spacing between the two parts which are moving relative to each other and between which the electric contact is to be established.

In accordance with another feature of the present invention, the brush holder part is normally not urged towards the second part, that is to say, contrary to traditional brush holders, it is not indispensable to provide a device which provides a pressure for urging the brushes against the moving contact zone of the other part.

Sliding electric contact devices with multifilament brushes formed of thin wires of a diameter of less than 80 microns are already known which have been developed essentially to limit electrical losses and are intended for use with the application of pressure against a smooth track in a neutral or slightly reductive atmosphere. Contrary to that teaching, the applicants have discovered a technique which maintains the brush support part at a substantially constant distance from the contact area of the part facing it, without exerting on said brush holder part any pressure tending to push the brushes against the other part. The free length or overhang of the wires of said brushes extend a length greater than the normal spacing between the two parts, whereby the inherent elasticity of the component wires of the brushes make it possible to assure in a controlled manner that the required contact with the contact zone by having an elastic deformation by flexure of the free end of the bundle of wires, thus overcoming the problem of applying of a pressure against the brush holder and accordingly conditions of use in a rarified atmosphere or under conditions of high pressure.

As a matter of fact, furthermore, contrary to the teachings of the prior art, this elastic flexure of the brushes is in no way harmful to their life, particularly upon a reversal in relative displacement of the two parts. On the contrary it proves beneficial by favoring relaxation of the wires and permitting a greatly increased useful life. This latter discovery makes it possible in particular to use these brushes with rings which are no longer smooth but rather transversely grooved, and also with blade collectors while guaranteeing optimum electrical contact even under difficult gaseous conditions or when immersed in a liquid. As a matter of fact, contrary to the solid electrographitic rings, the bundle of wires, due to their flexibility and divided aspect substantially eliminates oil wedges and, by not including any vacuum-producing wake, makes it possible to obtain excellent electrical contact even with liquids having a substantial viscosity.

It will therefore be seen that the device in accordance with the present invention makes it possible to produce sliding or turning electrical contacts which are immersed in a gas or liquid which is relatively dielectric and possibly hostile as mentioned above, and also finds advantageous use in special arrangements of rotating machines.

It is known that the electric-charge transfer characteristics and the establishing of transients are greatly improved in an electric contact device by using an intermediate "wetting" agent which is a good conductor of electricity, typically a liquid metal, deposited on at least one of the contact elements.

The present invention also proposes a turning sliding-contact device in which at least a part of the interface between the first and second parts which face each other is occupied by layer of a liquid metal, advantageously arranged on the contact surface of the second part.

The property mentioned above relative to the nonformation of oil wedges and the relative insensitivity of the brushes to a relative flow of the liquid in which they are contained has made it possible to obtain entirely unprecedented results by using these brushes in a liquid-metal electric contact chamber, for instance for homopolar machines. It is known that in this type of chamber surface-contact problems between the liquid metal and the adjacent contact surfaces of the stator or rotor arise which are related to the speed of rotation and the electric fields acting on the mass of contact-liquid metal and lead to uncontrolled radial separations of the veins of liquid metal. Complicated and delicate solutions have been proposed to overcome these drawbacks, particularly by effecting a continuous reinjection of liquid metal into the chamber under high pressure.

Another object of the present invention is to overcome these defects in an effective manner without requiring auxiliary structural or power equipment by means of a reliable simple system requiring no maintenance by installing entirely immersed brushes of the type defined above at least in the zones of localized contact of such liquid metal electric contact chambers, the brushes effecting a "blocking" effect or more precisely a braking effect on the vein of liquid metal without inducing harmful disturbances in the flow of said vein while playing a supplementary role which assures electric contact in the unforeseen cases of leaks or partial emptying of the chamber.

Other characteristics and advantages of the present invention will become evident from the following description of embodiments, given by way of illustration and not of limitation, read with reference to the accompanying drawings in which.

DESCRIPTION OF THE PREFERRED EMBODIMENT

Figure 1:
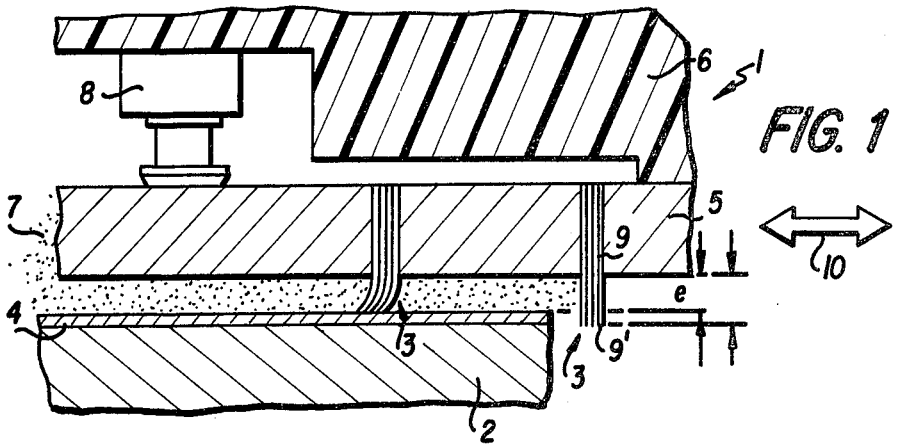
FIG. 1 is a diagrammatic view in longitudinal section of an electric contact device in accordance with the present invention.

The device shown in FIG. 1 comprises a brush-holder part (member) 1 and an adjacent part (member) 2, which parts are capable of moving relative to each other as indicated by the arrow 10 while retaining a substantially constant average spacing e between the outer face of the brush support 5 and the outer face of the electric contact zone 4 of the part 2. In FIG. 1, the part 2 is for instance a current distribution rail, the part 1 being a contact-shoe member integral, for instance, with a motor car. The brush support part 5 is mounted rigidly on the body 6 of the part 1 or is optionally floating, with the interposition of a play take-up device 8 which does not induce any substantial force on the brush support part 5 in the direction of the track 2. At 7 there is shown a liquid or mist in which the electric contact device is immersed. In accordance with the present invention, the brushes 3 which establish the electric connection between the parts 1 and 2 and are formed of a bundle of thin metallic wires which are good conductors of electricity and easily work-hardened, comprise an embedded part 9 and a free or overhang part 9' whose length l is greater by at least 10%, and preferably 15 to 20%, than the distance e between the parts 1 and 2, so that the free end 9', in the position of use, assumes a flexed configuration as shown on the left-hand brush of FIG. 1.

Figure 2:
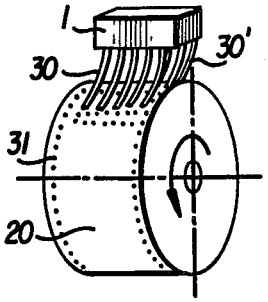
FIG. 2 illustrates one embodiment, applied to a rotating machine with a smooth collector ring.

FIG. 2 shows the previous system applied to a rotating machine with a smooth ring 20 against which there bear at least two rows 30, 30' of metal bundles 3', the rows extending parallel to the axis of rotation of the ring 20.

Figure 3:
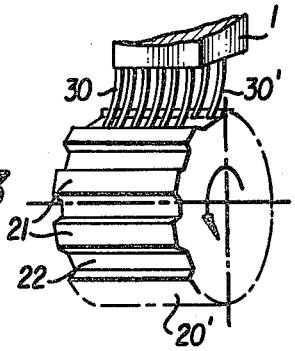
FIG. 3 shows one embodiment of a rotating machine with a grooved collector ring.
Figure 4:
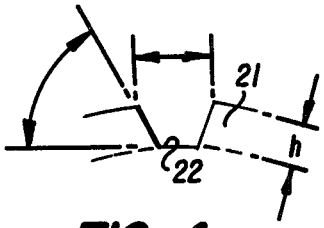
FIG. 4 is a partial view in detail of one groove of the ring of FIG. 3.

FIG. 3 shows a variant of the system of FIG. 2 in which the smooth ring 20 has been replaced by a grooved ring 20' having grooves 22 which extend parallel to the axis of rotation, these grooves defining longitudinal ribs 21 with the nominal diameter of the ring 20'. As mentioned above, although these grooves have the effect of increasing the difference in contact potential, they favor better preservation with time of the bundles of wires 30, 30' and thus make it possible to obtain greater stability for this difference in contact potential. As shown in FIG. 4, the width at the top $\lambda$ of the grooves 22 is advantageously between 2 and 5 mm, the depth h of these grooves being advantageously on the order of 2 mm, determined so that the bottom of the groove 22 is at a level not capable of being reached by the ends of the wires 3 in their position of full radial extension. The angle $\alpha$ of the faces of the grooves is selected to be between 45° and 60° and preferably 60°.

Figure 5:
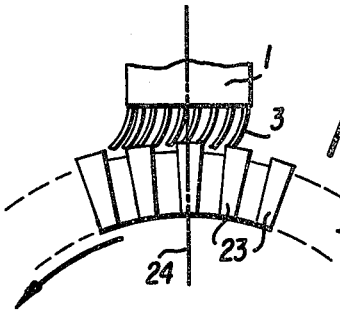
FIG. 5 is a diagrammatic end view of a rotating machine with commutator.

FIG. 5 shows a similar system but applied this time to a dc rotating machine comprising a collector 20'' with blades 23 separated from each other by insulating blades, for instance mica-covered blades. In FIG. 5 there can be noted the series of parallel rows of bundles of wires 3, these bundles possibly having a circular cross section or else a cross section elongated in the direction of passage of the collector blades so as to cover a number of these collector blades in order to assure good commutation and favor the reversal of the direction of rotation. The staggering of the bundles of wires with respect to the theoretical neutral line 24 of the collector blades will also be noted.

Figure 6:
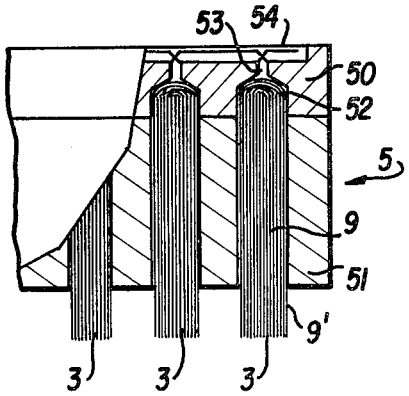
FIG. 6 shows on a larger scale one method of mounting the brushes in accordance with the present invention.

In accordance with the present invention, the wires of the brushes have a small diameter of between about 10 μm and 300 μm, preferably on the order of 60 to 100 μm. The free length l of these wires is relatively slight and is advantageously maintained less than 15 mm. The wires are made of a hard-metal alloy of good elasticity and good conductivity, for instance of cadmium or of FeSi alloy and are made by drawing, followed possibly by work-hardening. The transverse resistance of the bundles of wires can be increased artificially by insulating the wires from each other, for instance by covering them individually with a sheathing and by securing them in a resistant base 51 as shown in FIG. 6. The flexibility of the wire brushes and their only slight abrasive character permit for the contact tracks or zones 4 of the rings 20, 20' any suitable electrically conductive material such as copper or copper-zirconium alloys.

As shown in FIG. 1, the brushes 3 may be fixed in a copper support 5 or, as shown in FIG. 6, with their inner ends engaged in a cup 52 formed in a copper part 50, the fixing of the wires and the determination of their free length being obtained by a perforated plate 51 of insulating material. The same structure can be used with a plate 51 which is no longer of a material which is a non-conductor of electricity but of a material which is a good conductor and forms a radiator for the evacuation of the heat dissipated in the wires. The latter, as shown in FIG. 6, can be put in place in the manner of tufts in brush-making, each bundle being formed of a package of wires bent as a hair pin and held in the cup 52 by a loop 53, for instance of brass wire, the bundles being connected on the rear face of the plate 50 by another brass wire 54.

Typically, the wires are combined in bundles having a diameter of less than or equal to 10 mm and are assembled in parallel rows close to each other so that the wires of the different bundles can touch upon flexure. More particularly, in collector machines, the bundles can be arranged along a stagger as a function of the contemplated current density. The arrangement in accordance with the present invention permits current densities of up to 100 amperes/cm$^2$ at linear speeds of passage of up to 50 m/s$^{-1}$ and above, permitting a life, upon immersion in non-oxidizing dielectric liquids or gases, of up to several thousands of hours. These characteristics can be further increased by incorporating lubricating filaments in the bundles of wires.

The arrangement in accordance with the present invention has proved effective for punctiform uses in any liquid or gas which is relatively non-oxidizing and of a resistivity of less than 0.5 ohms/meter (for instance sea-water), the very slight abrasive effect of the brushes on the contact surface of the second part making it possible to preserve a thin film of protective gold deposited on said surface for a long period of time. With liquids of a viscosity of less than 100 centipoises, such as mineral oils, hydrocarbons or potash brines, the device has proven to have a very satisfactory life.

The ability of the brushes to maintain the electric contact when immersed in a liquid, even at high speeds, also makes it possible to use the electric contact device of the present invention in rotating systems with electric contact assured, at least in part, by a liquid metal compatible with the material of the brushes, such as HgIn or the eutectic NaK. In particular, in any type of smooth-ring machine, one can advantageously deposit a thin layer of liquid metal on the surface of said ring, as shown at 31 in FIG. 2, this liquid metal assuring a "wettability" effect of said surface which considerably improves the quality of the electric contact with the brushes 30 whose free contact ends will furthermore be provided permanently with a small amount of said liquid metal, which is held in particular by capillary action.

Figure 7:
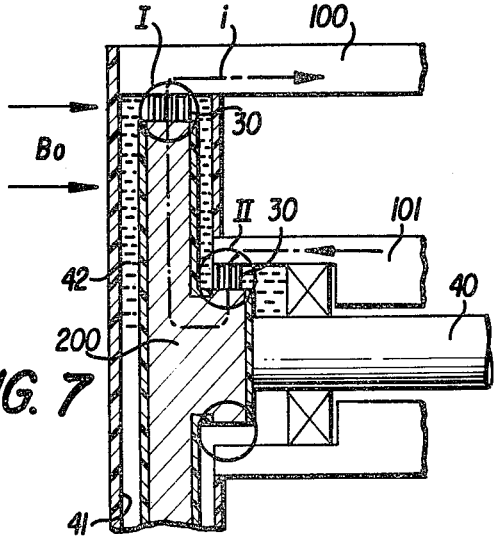
FIG. 7 shows diagrammatically a rotating machine with liquid metal electric contact chamber in accordance with a another feature of the present invention.

FIG. 7 shows a particularly important development of the present invention. This figure diagrammatically shows a homopolar machine with contact by liquid metal, the outer induction Bo being created, for instance, by a supraconductive solenoid to reach values on the order of several Teslas. The disk 200 which is secured fast to the shaft 40 of the rotor is mounted in a cylindrical chamber 41 so as to define with the stator shell elements 100, 101 two annular localized contact zones I and II for the passage of the current i whose path is shown in dot-dash line, the closing of the current circuit being assured in the contact zones by the liquid metal 42 which at least partially fills the chamber 41, this metal or alloy having wetting-agent characteristics, a high conductivity and a large range of temperature between its boiling point and freezing point. The electrically insulated surfaces of the chamber are shown in insulator hatchings. In accordance with the present invention, within the contact zones I and II there are arranged, between the stationary elements 100 and 101 and the periphery of the disk 200, at least two rows of bundles of wires 30 of the type defined above, the object of which is in particular to "calm" or block the placing in rotation due to Laplace forces of the vein of liquid metal in these zones by substantially slowing the relative excess speeds of these veins and thus permitting improved operation at low cost of the machine for high speeds of rotation.

Although the present invention has been described in connection with special embodiments, it is not limited thereto but rather is capable of modifications and variants which will be evident to the man skilled in the art.

We claim:

1. An electric contact device for maintaining sliding electrical contact between two members moving relative to one another comprising:

a first member;

a second member having an electrically conductive portion spaced from said first member by a substantially constant average spacing and coupled such that said first and second member are movable relative to one another while maintaining said substantially constant average spacing, said second member being configured in the form of a transversely grooved rotating ring;

at least one multifilament brush formed as a bundle of thin electrically conducting wires having a first end received in said first member and a free end extending from said first member and into contact with said electrically conductive portion of the second member, said free end having a length extending between said first and second members which is 10%–20% greater than said average spacing, said brush having an elasticity such that the free end of said brush is maintained in contact with said electrically conductive portion solely due to that elasticity; and a liquid maintained between said first and second members in which said at least one brush is emersed.

2. The device of claim 1 wherein said grooves form a space between said first and second member which is greater than the length of said free end.

3. The device of claim 1 or 2 wherein said second member is a bar commutator of a rotating electrical machine.

4. The device of claim 1 or 2 wherein each of said wires in said bundle are individually covered with an insulating sheath.

5. The device of claim 4 wherein said first end has a length which is imbedded in said first member.

* * * * *